US009452953B2

(12) United States Patent
Cranney et al.

(10) Patent No.: US 9,452,953 B2
(45) Date of Patent: Sep. 27, 2016

(54) COMPOSITIONS, METHODS, AND SYSTEMS FOR NITRATE PRILLS

(71) Applicant: Dyno Nobel, Inc., Salt Lake City, UT (US)

(72) Inventors: Don Cranney, South Jordan, UT (US); Robert Bingham, Oakley, UT (US); Lee McKenzie, Lehi, UT (US)

(73) Assignee: Dyno Nobel, Inc., Salt Lake City, UT (US)

( * ) Notice: Subject to any disclaimer, the term of this patent is extended or adjusted under 35 U.S.C. 154(b) by 53 days.

(21) Appl. No.: 14/172,338

(22) Filed: Feb. 4, 2014

(65) Prior Publication Data

US 2014/0216616 A1 Aug. 7, 2014

Related U.S. Application Data

(60) Provisional application No. 61/761,085, filed on Feb. 5, 2013.

(51) Int. Cl.

| | |
|---|---|
| ***C06B 45/18*** | (2006.01) |
| ***C06B 45/30*** | (2006.01) |
| ***C06B 45/32*** | (2006.01) |
| ***C06B 45/34*** | (2006.01) |
| ***D03D 23/00*** | (2006.01) |
| ***D03D 43/00*** | (2006.01) |
| ***C06B 31/28*** | (2006.01) |
| ***C06B 31/02*** | (2006.01) |
| ***C06B 47/14*** | (2006.01) |

(52) U.S. Cl.
CPC ..... *C06B 31/28* (2013.01); *C06B 31/02* (2013.01); *C06B 47/145* (2013.01)

(58) Field of Classification Search
USPC ..... 149/7, 3, 5, 6, 109.6
See application file for complete search history.

(56) References Cited

U.S. PATENT DOCUMENTS

| | | | | |
|---|---|---|---|---|
| 4,384,903 | A * | 5/1983 | Enever | C06B 47/14 149/112 |
| 5,034,071 | A * | 7/1991 | VanOmmeren | C06B 47/145 149/2 |
| 5,076,867 | A * | 12/1991 | McKenzie | C06B 31/285 149/109.6 |
| 5,486,246 | A * | 1/1996 | Kelley | C06B 31/28 149/2 |
| 2002/0096235 | A1* | 7/2002 | Blomquist | C01C 1/18 149/46 |
| 2009/0111716 | A1* | 4/2009 | Hough | C09K 8/584 507/214 |

FOREIGN PATENT DOCUMENTS

WO WO 2011/036611 A1 3/2011

OTHER PUBLICATIONS

PCT Application PCT/US2014/014630; filed Feb. 4, 2014; Dyno Nobel, Inc.; International Search Report mailed Jun. 5, 2014.

* cited by examiner

*Primary Examiner* — James McDonough
(74) *Attorney, Agent, or Firm* — Stoel Rives LLP

(57) ABSTRACT

Compositions, methods and systems involving nitrate compounds are disclosed and described. A method of dissolving a nitrate compound having an additive can comprise dissolving the nitrate compound to form an aqueous nitrate solution and adding a surfactant to the aqueous nitrate solution, where the surfactant disperses the additive.

23 Claims, No Drawings

COMPOSITIONS, METHODS, AND SYSTEMS FOR NITRATE PRILLS

PRIORITY DATA

This application claims the benefit of U.S. Patent Application Ser. No. 61/761,085, filed Feb. 5, 2013, which is incorporated herein by reference.

FIELD OF TECHNOLOGY

Embodiments of the invention relate generally to compositions, methods, and systems directed to nitrate compounds in various applications. Accordingly, the present invention involves the fields of chemistry and explosives.

BACKGROUND

Nitrate salts, such as ammonium nitrate ("AN"), has been used as both a liquid-water solution and as solid particles (e.g. prills) in the fertilizer and explosives industry. Ammonium nitrate is made from anhydrous ammonia and nitric acid, which is also synthesized from ammonia, and is produced in forms ranging from liquid solutions, to crystals, to porous, multi-crystalline agglomerates. Such compounds include granules and prills. These compounds generally have coatings applied thereto after the granule or prill is formed to prevent caking and clumping. Such compounds have also been developed which include internal additives used during the granulating or prilling process to produce a high-quality salts. Solid forms of nitrate salts encountered in industry include high density prills (low porosity) and granules, which are made by a granulation process.

Typical external coatings for nitrate compounds can be binary, i.e., two distinct materials, that act synergistically in their function physically and/or chemically. For example, an organic surfactant can be used to help clay or talc adhere to the nitrate compound and/or also contribute to anti-caking properties. Typically, the clay or talc acts as a "physical parting agent" and the surfactant acts chemically as an "anti-caking agent." Both actions reduce caking and clumping of the nitrate compound. More common in the industry today, nitrate compound coatings are strictly organic in nature consisting of blends of such materials including: mineral oil, waxes, anionic and cationic surfactants. These mixtures provide both physical and chemical action to prevent caking. Caking and clumping of nitrate compounds before use is a common problem in industry and it occurs more frequently in the summer months during high humidity conditions.

Ammonium nitrate is the basis for almost all commercial explosives used in the world today. For example, water-in-oil emulsion explosive compositions are one of the prevalent commercial explosives. They are composite explosives that comprise an emulsified dispersion of a discontinuous phase of oxidizer salt solution droplets (comprising AN with possible another oxidizer salts) in a continuous organic fuel phase. This dispersion or emulsion phase is held in place (stabilized) by a water-in-oil emulsifier(s) system that largely prevents coalescence of the dispersed oxidizer phase. The inorganic oxidizer salt solution droplets are typically in a super-cooled state and thus want to crystallize, consequently destabilizing the emulsified state. Thus, if the emulsified state is weakened by stress, aging or emulsion poisons (materials that cause de-emulsification), the emulsion will manifest this by crystallization which desensitizes the emulsion explosive and can render it un-detonable.

Ammonium nitrate in solid particulate form, generally as prills typically 1-3 mm in diameter, is also widely used in admixtures with emulsion explosives. Explosives consisting of a water-in-oil emulsion and oxidizer salt prills, generally ammonium nitrate prills, are known as "blended explosives" and have a high bulk density, good blasting energy and can have good water resistance depending on the ratio of emulsion to AN or ANFO (ammonium nitrate/fuel oil mixture) in the blend. However, disadvantages involved in the use of blended explosives having particulate oxidizer salt relate to the blend's pumpability and stability. More importantly, the blend's stability relates directly to the explosive properties of the blend. Further, some blends must be-processed, loaded, and detonated expeditiously after blending because over a short period of time the emulsion destabilizes ("breaks") and becomes hard, thus making the blend unpumpable and even undetonable. This can be especially true for blended emulsions using prills or other solid forms having certain internal additives and/or coatings which can act to destabilize the emulsion component of the blend.

In many places in the developed world, AN solution has been available directly from manufacturing plants. This "virgin liquor" gives the optimum stability to emulsion products. However, as blasting operations spread to more remote regions, far from AN plants, the necessity of using solution made from dissolving AN compounds to blend emulsion explosives is rapidly increasing.

SUMMARY OF INVENTION EMBODIMENTS

It has been recognized that it would be advantageous to develop compositions, methods, and systems that allow for the use of AN compounds in forming stable aqueous compositions. Specifically, the present inventors have discovered that the use of a surfactant can disperse the additives used in the manufacturing of nitrate compounds, including insoluble organic coatings, mineral parting agent and/or insolubles internal to the compound.

In one embodiment, a method of dissolving a nitrate compound having additives includes dissolving the nitrate compound to form an aqueous nitrate solution and adding a surfactant to the aqueous nitrate solution, where the surfactant disperses the additives.

In another embodiment, an aqueous nitrate solution can include a nitrate salt, additives, and a surfactant, where the surfactant disperses the additives.

Additionally, a nitrate compound can include a nitrate salt, additives, and a surfactant, where the surfactant disperses the additive when the compound is dissolved.

Further, a method of making a nitrate compound can comprise adding a surfactant to the compound that will disperse any additives present in the compound.

Still further, a method of making an emulsion explosive composition from a nitrate compound having an additive can comprise dissolving the nitrate compound to form a nitrate solution and adding a surfactant to the solution that disperses the additive.

In one embodiment, a method of reducing contamination in a mixing tank for an aqueous nitrate solution made from a nitrate compound can include adding a surfactant to the aqueous nitrate solution either during or after dissolution. The aqueous nitrate solution can include nitrate salt and associated additives. Further, the surfactant can disperse the additives in the aqueous nitrate solution. Generally, heating and agitation of the solution is necessary to effect optimal dispersion of the additives.

A system for reducing contamination in a mixing tank for an aqueous ammonium solution made from a nitrate compound can comprise the nitrate compound and a surfactant. The nitrate compound can include associated additives, where, upon dissolving the nitrate compound in an aqueous solution to form the aqueous nitrate solution, the surfactant disperses the additives.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

DETAILED DESCRIPTION OF INVENTION EMBODIMENTS

Before the present invention is disclosed and described, it is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an," and, "the" include plural referents unless the context clearly dictates otherwise. Thus, for example, reference to "a prill" includes one or more of such prills, reference to "an amount of surfactant" includes reference to one or more amounts of surfactant, and reference to "the nitrate compound" includes reference to one or more nitrate compounds.

DEFINITIONS

In describing and claiming the present invention, the following terminology will be used in accordance with the definitions set forth below.

As used herein, "nitrate compound" refers to a solid form of a nitrate salt. Such forms can include prills or granules, unless otherwise stated.

As used herein, "prill" refers to solid, multi-crystalline particles formed in a prilling process.

As used herein, "prilling" refers to formation of solid particles or "prills" in an open tower via solidification as droplets fall from a prill head. A prill head is the apparatus at the top of a prill tower which divides the molten material into the droplets from which the prills form.

As used herein, "additives" refers to materials used in the manufacturing of AN compounds, including insoluble organic coatings, mineral parting agent and/or insolubles internal to the compound.

As used herein, "disperse" refers to the breakup of insoluble surface or bottom layers such that agitation of the solution is sufficient to minimize coating of insoluble materials on tanks, pipes and other surfaces. In one embodiment, the dispersion can be substantially uniform throughout the solution and hence throughout the products made from the solutions such as emulsion explosives. In one aspect, stirring at a speed of up to 1, 10, 20, 50 or even 100 rpm may be sufficient to "disperse" as defined herein.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term, like "comprising" or "including," it is understood that direct support should be afforded also to "consisting essentially of" language as well as "consisting of" language as if stated explicitly.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

As used herein, the term "substantially" or "substantial" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking, the nearness of completion will be so as to have the same overall result as if absolute and total completion were obtained. The use of "substantially" is equally applicable when used in a negative connotation to refer to the complete or near complete lack of action, characteristic, property, state, structure, item, or result. For example, a composition that is "substantially flee of" particles would either completely lack particles, or so nearly completely lack particles that the effect would be the same as if it completely lacked particles. In other words, a composition that is "substantially free of" an ingredient or element may still contain such an item as long as there is no measurable effect thereof.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in orange format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 micron to about 5 microns" should be interpreted to include not only the explicitly recited values of about 1 micron to about 5 microns, but also include individual values and sub-ranges within the indicated range. Thus, included in this numerical range are individual values such as 2, 3.5, and 4 and sub-ranges such as from 1-3, from 2-4, and from 3-5, etc.

This same principle applies to ranges reciting only one numerical value. Furthermore, such an interpretation should apply regardless of the breadth of the range or the characteristics being described.

Invention Embodiments

The present inventors have recognized that it can be logistically and process prohibitive to transport hot nitrate solution, e.g. AN solutions, to explosive plants in regions outside of nitrate processing plants. Additionally, the inventors have recognized that the use of nitrate compounds (e.g. AN prills) for solution brings into play physical process difficulties at the emulsion plant and chemical difficulties for making adequately stable emulsions.

Firstly, such additives can cause stability problems of the emulsion and can cause performance problems of the explosive. Secondly, the organic coatings in use on nitrate compounds (e.g. AN prills) today tend to be water-insoluble and thus float and/or collect on the plant processing tanks, piping, etc. This fouling can be drawn intermittently into the emulsification process whereby it creates zones of product instability.

In light of the above, it has been recognized that it would be advantageous to develop compositions, methods, and systems that allow for the use of nitrate compounds in forming stable, uniform aqueous compositions and resulting emulsions.

Notably, nitrate compounds, e.g., AN prills, have been increasingly used to form nitrate solutions for the purposes of preparing fertilizers and explosives. Such compounds commonly include aqueous-insoluble coatings, parting agents and/or internal additives that generally include organics such as waxes, oils, organic surfactants, etc. Such additives have often been considered a tolerable contaminant as long as the compounds can be blended into a substantially uniform solution. Unfortunately, such additives can agglomerate during the dissolution process tend to float to the surface of the solution and also contaminate (adhere to) the sides and surfaces of the tank in which the dissolution takes place as well as foul the downstream processing equipment as well as the resulting emulsions. Such contamination typically has adverse effects on the resulting product and equipment. Further, such contamination can be greatly magnified after the processing of multiple batches of solution. The present inventors have discovered that the addition of certain surfactants, along with any desired stirring, agitation, etc., and/or with heating, can disperse such additives and avoid the problems noted herein, while not adversely affecting the stability of the final product to a degree that it affects beneficial use of the product.

In one embodiment, a method of dissolving a nitrate compound having an additive can comprise dissolving the nitrate compound to form an aqueous nitrate solution and adding a surfactant to the aqueous nitrate solution. Where the surfactant disperses the additive. In one embodiment, the method Call further include heating the aqueous nitrate solution. Additionally, the dispersing generally includes mixing of the solution. Generally, the nitrate compound comprises a nitrate salt including without limitation calcium nitrate, sodium nitrate, ammonium nitrate, and mixtures thereof. In one aspect, the nitrate compound can comprise ammonium nitrate. Additionally, the nitrate compound can be a nitrate prin. In one aspect, the nitrate compound can be an ammonium nitrate prill.

Generally, nitrate compounds comprise a nitrate salt, e.g. ammonium nitrate, and an additive(s). As discussed herein, the nitrate compound can be coated. In one embodiment, the additive can be present in an organic coating covering the surface of the nitrate compound, or may comprise the organic covering the nitrate compound. In one aspect, the organic coating consists essentially of the additive, or in another aspect, can consist of or include the additive. In another embodiment, the additive can be present throughout the nitrate compound. As such, in one aspect, the additive can be present homogenously throughout the nitrate compound, or in another aspect, can be present in specific locations in the nitrate compound.

Additives considered include any of those used in the manufacturing of nitrate compounds as known in the art. In one embodiment, the additives can be selected from the group consisting of: mineral oil, waxes, anionic surfactant, cationic surfactants, non-ionic surfactants, and mixtures thereof. Additionally, the additives can consist of combinations of a number proprietary internal additives (organic or inorganic), proprietary coating blends containing such as oils waxes and surfactants, and inorganic parting agents. Current nitrate compound coating technology favors the use of products that consist of proprietary blends of oils, waxes and various surfactants which are mainly responsible of for the fouling of surfaces, equipment, etc. discussed herein. The organic coating blends will associate with any inorganic insoluble agents present such as from internal additives or parting agents, generally increasing the fouling problem.

As such, the present inventors have discovered the use of surfactants to disperse additives used in nitrate compound formation. The surfactants taught herein can act on the insoluble agglomerations to break them up, clean them off surfaces and, with gentle stirring, disperse uniformly in nitrate solutions formed by dissolving such nitrate compounds. Generally, the surfactant used herein can be any surfactant that is capable of dispersing the additives used in the manufacturing of nitrate compounds into an aqueous solution and which does not destabilize or otherwise affect the product (i.e., an emulsion) made from the solution, such that it cannot meet it intended use. As discussed herein, the present inventors have discovered that the use of such surfactants can provide stability to the resulting emulsions by aiding in more uniformly dispersing the additives into the emulsion, thereby providing better products with extended shelf life. Pockets of emulsion that contain concentrated amounts of additives, which de-stabilize the emulsion, can be avoided. Such concentrated amounts of additives, which frequently form at the surface of the solution, can lead to deposits on the walls of process equipment as this concentrated zone is pulled into the process.

The present compositions, methods, and systems can prevent the processing equipment associated with nitrate compound dissolution from getting fouled with additives; prevents the additives from sticking to the tanks, pipes and other surfaces. Notably, as several batch dissolutions are generally made in the equipment, the present compositions, methods, and systems, can prevent a buildup of surface layer (or sediment) of additives generally formed during processing. Additionally, the benefits of the present disclosure include avoiding the periodic clean out of the process circuit that must be made using standard processes as known in the art, as well as the minimization and/or elimination of the recovered materials from such clean outs, which are considered hazardous wastes due to the mixing of nitrates with the organic coatings. Thus, the present compositions, methods, and systems can avoid the down-time of such clean outs, as well as the handling/disposal costs of the recovered additives.

In one embodiment, the surfactant can disperse the additives upon mixing of the surfactant with the aqueous nitrate solution that contains the additives or can disperse the additives upon mixing with water and prill during dissolution to disperse the additives as they are released from the dissolving nitrate compound. In one aspect, after adding of the surfactant and forming a dispersed state of additives in the nitrate solution, the additives can be broken up into small insoluble globules that will remain suspended as long as there at least gentle stirring of the solution. If stirring is stopped, the individual globules, generally, will gradually float to the surface of the solution or may associate with the walls of the tank. This can occur over a period of up to about one hour. The globules can remain individual but loosely flocked together. If at least gentle stirring is re-initiated, the globules can be drawn back into dispersion. The amount and speed of stirring is generally dependent on the underlying physical state of the dispersed globules, e.g. size, and is dependent on both the efficacy of the specific surfactant chosen and the concentration of said surfactant. In one aspect, stirring or agitation should at least be sufficient to cause disruption or movement at the surface of the solution, and can be by any means, including such as impellers, air-sparging, vibration, water jet, shaking, tipping, rotating, etc. The actual motion needed, for instance as quantified by rpm in the case of an impeller, is dependent on the size and configuration of the vessel containing the solution. In another aspect, the surfactant can disperse the aqueous nitrate solution containing the additives such that the additives do not irreversible adhere to the surfaces off a dissolution tank. In still another aspect, the surfactant can disperse the aqueous nitrate solution containing the additives such that, when the nitrate solution is contained in glass, the additive does not adhere to the glass.

As discussed herein, the surfactant can be anionic, cationic, nonionic, and amphoteric. In one embodiment, the surfactant can include alkoxylated diamines, alkanolamides, alkyl esters, alkyl amines, alkyl amine ethoxylates, alkyl sulfonates, alkyl napthalene sulfonate, amine oxides, amine ethoxylates, amido amines, betaine amphoterics, block copolymer surfactants, carboxylated ether amines, ethoxylated alcohols, ethoxylated nonyl phenols, ethoxylated amines, ethoxylated triglycerides, ethoxylated amines, ethoxylated glycerol esters, ethoxylated alkyl phenols, ethoxylated polyglycerol esters, ethoxylated sorbitol esters, ethoxylated fatty acids, ethoxylated ether amines, ether amines, fatty acid alkanolamides, glycerol esters, glycol esters, imidazolines, imidazolinium amphoterics, monohydric alcohol esters, nonyl phenol ethoxylates, organo phosphates, organo phosphate ethoxylates, polyglycerol esters, polyhydric alcohol esters, quaternaries, silicone based surfactants, sorbitol fatty acid esters, sulfosuccinates, sultaines, and mixtures thereof.

Additionally, in one aspect, the surfactant can include an alkyl amine ethoxylate, cocamidopropyl hydroxyl sultaine, and mixtures thereof. In one aspect, the surfactant can be an alkyl amine ethoxylate. In another aspect, surfactants that can be classified as hydrotropes, i.e., substances that improve the solubility of other surfactants in water or solutions with high electrolyte levels, offer potentially viable candidates. Generally, the amount of surfactant needed for dispersion is dependent upon the amount and type of additive present. The range can be about 0.0005 wt % to about 1.0 wt % of the solution weight. As such, in one embodiment, the surfactant can be efficacious in an amount of about 0.005 wt % of the total nitrate solution of the additive present. In one embodiment, the surfactant can be added to the aqueous nitrate solution in an amount of about 0.0005 wt % to about 0.1 wt % based on the total weight of the solution. In one aspect, the surfactant can be present in an amount of 0.005 wt % to about 0.05 wt %.

Additionally, an aqueous nitrate solution can comprise a nitrate salt, an additive, and a surfactant, where the surfactant disperses the additive. As discussed herein, the additive originates from the nitrate compound. As the compound dissolves, the surfactant can be added. Alternately the surfactant can also originate from the nitrate compound, specifically placed there with the function of dispersing the additives when used to blend solution. As such, in one aspect, the nitrate compound can contain a surfactant in the compound, and in one aspect, in a coating on the compound.

Generally, the nitrate in the form of the nitrate salt can be present in the aqueous solution in an amount of about 60 wt % to about 95 wt %. In one aspect, the nitrate can be ammonium nitrate and can be used in explosives. The additive can be present in the aqueous nitrate solution in an amount of about 0.0005 wt % to about 0.8 wt %, and in one aspect, about 0.008 wt % to about 0.002 wt %. The surfactant can be present in the aqueous nitrate solution in an amount of about 0.0005 wt % to about 0.1 wt %.

As discussed herein, the present inventors have discovered the use of a surfactant to disperse additives commonly used in nitrate compound making processes, e.g., prill making processes. As such, in one embodiment, a nitrate compound can comprise a nitrate salt, an additive, and a surfactant. The surfactant can disperse the additive upon dissolution of the compound. The composition of the nitrate compound can vary depending on intended use. In one embodiment, the nitrate can be present in the nitrate compound in an amount of about 98 wt % to 100 wt %, the additives can be present in the nitrate compound in an amount of 0.02 wt % to 0.3 wt %, and the surfactant can be present in the nitrate compound in an amount of 0.0005 wt % to 0.05 wt %.

In addition to the above, a method of reducing contamination in a mixing tank for an aqueous nitrate solution can comprise adding a surfactant to the aqueous nitrate solution, the aqueous nitrate solution including a nitrate salt and associated additives, where the surfactant disperses the additives in the aqueous nitrate solution. The surfactant can be added during the dissolution or after the dissolution, in association with any necessary agitation and/or heating in the process.

Further, a system for reducing contamination in a mixing tank for an aqueous nitrate solution can comprise a nitrate compound, as described herein, and a surfactant. Upon dissolving the nitrate compound in an aqueous solution to form the aqueous nitrate solution, the surfactant disperses the additive.

A method of making a nitrate compound can comprise adding a surfactant to the nitrate compound. In one embodiment, the surfactant can be added to the nitrate compound by incorporating the surfactant into the nitrate compound. In another embodiment, the surfactant can be added to the nitrate compound by incorporating the surfactant into an organic coating that covers the surface of the nitrate compound.

A method of making an emulsion explosive composition from a nitrate compound having an additive can comprise dissolving the nitrate compound to form a nitrate solution.

EXAMPLES

The following examples illustrate embodiments of the disclosure that are presently known. Thus, these examples should not be considered as limitations of the invention, but are merely in place to teach how to make compositions of the present disclosure and identify suitable surfactants. As such, a representative number of compositions and their method of manufacture are disclosed herein.

Example 1

Surfactant Criteria

The identification of surfactants suitable for acting as dispersants covered by this invention requires specific characteristics and associated functional testing of the candidates. The following guidelines can be used to select the appropriate surfactant:

1. The surfactant can generally be soluble in or dispersible in the hot nitrate/water solutions that are the target of the invention. This characteristic can be functionally determined by adding the surfactant to a stirred, hot solution of nitrate/water and noting the disposition of the surfactant both while stirring and afterward when quiescent. If the surfactant dissolves or if the surface layer of the surfactant easily disperses into a cloudy dispersion with gently stirring then the surfactant meets this criteria.

2. The surfactant can also generally be soluble in or dispersible in (penetrate) the coating material that it will be acting on in the solutions. This can be determined by direct observation similar to above, substituting the liquefied (heated if necessary) coating material as the solvent, to which the surfactant is added and stirred into.

3. In bench scale testing involving surfactant candidates and nitrate compound sources of interest, vigorously stirred dissolution of the compound in heated water with the surfactant present in variable concentrations as needed, is monitored compared to control solutions without the surfactant present. Upon complete dissolution of the nitrate compound, a cloudy solution in the test sample with the surfactant is an indication of dispersion. The control solution often appears clear with masses of coating "additives" visible and floating around; however, if inorganic parting agents or insoluble internal additives are present from the nitrate compound, the cloudy observation may be inconclusive.

4. Upon allowing the warm/hot nitrate solutions to sit quiet, the organic coatings in the control mix will either rise to the surface of the mix or sink to the bottom if affiliated with heavy inorganic insoluble and may also coat the container walls. Upon gentle re-stirring, the mass of agglomerated additives will remain in lame masses (often at the surface of the solution) or stuck to the process equipment/walls. Conversely, if the surfactant in the test mix continues as a candidate in this invention, gentle stirring will re-disperse the surface or bottom layers and generally any layers on the equipment walls into the bulk of the solution, cousin again the cloudy appearance. This test can be most critical in determining the dispersive capabilities of the candidate surfactant.

5. The solution made from the dissolved nitrate compound with the dispersion surfactant present must be compatible in the product or use for with the solution is intended. For example, for use in explosive emulsions, the stability and suitability of the product should be ascertained by the manufacturer using their normal methodologies to ensure sufficient shelf-life and functionality for the intended application.

6. Different nitrate compound sources require individual testing and may require different surfactant dispersing agents depending on the source.

7. Optimal functional levels and minimal functional levels of the candidate surfactant should be determined as outlined above. Frequently, using a minimal functional level will mitigate product stability issues or use limitations.

The surfactants or surfactant blends that might be efficacious in this invention can be any surfactant that meets the criteria above based on the testing outlined. This could anionic, cationic, non-ionic, amphoteric, and various blends including proprietary products. Of high potential interest would be surfactants or blends that are classified as hydrotropes, i.e., substances that improve the solubility of surfactants in water, especially in formulations containing high electrolyte levels. Regardless of class, the viability of the candidates is identified by the functional testing outlined above and such candidates are considered within the method and claims of this patent. Several candidates and surfactant classes are presented in the examples described herein, but these examples are certainly not exhaustive as to specific surfactant class, chemistry or product. All candidates meeting the criteria above are considered within the scope of the invention.

Example 2

Testing of Various Surfactants, Surfactant Blends, and Proprietary Blends Using Criteria and Methods Previously Described Each surfactant was added to an aqueous ammonium nitrate solution formed from an AN prill front the Donora Manufacturing Facility of Dyno Nobel located in Donora, Pa. The Donora AN prill typically has about 1000 ppm of a proprietary organic coating, as well an inorganic internal additive. Table 1 provides the solution components.

TABLE 1

Oxidizer Solution Composition

| Components | Oxidizer Solution |
|---|---|
| AN Prill (Donora) (g) | 80 |
| Water (g) | 20 |
| pH | 4.0-4.5 |

The Solution shown in Table 1 was blended by mixing the AN prill with water and various surfactant candidate for testing as dispersants. The components were heated with thorough mixing until all the AN prill was dissolved. The tests results are shown on Table 3A,B below. The emulsion formulation shown in Table 2 was used to test stability and performance of the viable candidates when used in that formulation, a necessary part of the qualification testing.

TABLE 2

| Emulsion Formulation | |
|---|---|
| Oxidizer Solution, % | 94 |
| Non-Polymeric Pibsa-Based Polymeric Emulsifiers, % | 1.0 |
| Mineral Oil and Fuel Oil, % | 5.0 |

TABLE 3A

Results of Testing of Dispersant Candidate

| Mix # | Surfactant Class | Surfactant Type | Optimal Use Level (Wt % of Soln.) | Soluble/Dispersible in the Aqueous Ammonium Nitrate Solution | Soluble in or Penetration of the Surfactant into the Organic Coating? |
|---|---|---|---|---|---|
| 1 | None (Control) | None | — | — | — |
| 2 | Blend of Sorbitan Ester and Ethoxylated Sorbitan Ester | Nonionic Blend | Tested at 0.05% | No | Yes |
| 3 | Dish Soap (Dawn Detergent) | Blend | 0.15-0.20% | Yes | Yes |
| 4 | Alkyl Naphthalene Sulfonate | Anionic | 0.05-0.10% | Yes | Yes |
| 5 | Ethoxylated (3) Alkyl Diamine | Cationic[1] | 0.01-0.05% | Yes | Yes |
| 6 | Ethoxylated (5) Alkyl Amine | Cationic[1] | Tested at 0.05% | Yes | Yes |
| 7 | Cocamidopropyl hydroxyl Sultaine | Amphoteric | 0.05-0.10% | Yes | Yes |
| 8 | SEA BRAT Commercial Oil Dispersant | Blend | Tested at 0.05% | Yes | Yes |
| 9 | PETRO-CLEAN Commercial Oil | Blend | Tested at 0.05% | Yes | Yes |

TABLE 3b

Results of Testing of Dispersant Candidate

| Mix # | Coating Stick to Container Walls and/or Agglomerates at the Surface | Effectiveness in Dispersing the Prill Coatings, (Clear of Cloudy) | Re-Disperses with Gentile Stirring, Reforms Cloudy Dispersion | Is the Surfactant Compatible with the Emulsion? |
|---|---|---|---|---|
| 1 | Yes | No Dispersion | No Dispersion | — |
| 2 | Yes | No Dispersion | No Dispersion | Yes |
| 3 | Yes | Fair | Poor | Fair |
| 4 | Yes | Poor | Poor | No |
| 5 | No | Excellent | Excellent | Yes |
| 6 | Slight | Good | Good | Yes |
| 7 | Slight | Good | Good | Yes |
| 8 | Yes | Poor | Fair | — |
| 9 | Yes | Poor | Poor | — |

As shown in Tables 3A,B, the ethoxylated (3) alkyl diamine used in Mix No. 5 performed the best while SMO-1/PSMO-20K blend used in Mix 2 performed the worst. The results for Mix Nos. 4 and 6 also appear usable. The other mixes, including the commercial products, fail in one or more categories. This table demonstrates the approach in finding useable candidates. Mix No. 5 was further tested in the emulsion shown in Table 2 in the range of 0.005 to 0.05 wt % and was found to have sufficient stability for commercial application. It was also tested for detonation characteristics and performed as well as products without additives present.

Example 3

Field Testing of the Dispersant Shown in Mix #5 from Example 2

A sample of the ethoxylated (3) alkyl diamine was shipped to a Dyno Nobel plant in Canada that utilized AN solution made from dissolved Donora prills. The plant had some difficultly in handling the coating sludge deposits that were building up in the dissolver tank and had to periodically be cleaned out. The emulsion quality at the plant was sometimes affected as sludge materials were pulled into the product. The tanks at the plant were cleaned and batches of solution were then made using 0.05% (by weight of solution) of the supplied surfactant dispersant. The AN prill, water and surfactant were blended together with stirring and heating until dissolved. The results were immediate in solving the sludge problem and further optimization of the percent use of the dispersant resulted in lowering the level to 0.005% of the solution. All the solutions made were successfully blended into the emulsion product, essentially the same as the formulation shown in Table 2 above. The products were handled and shot with normal results. The surfactant solved the ongoing problems with the coating sludge.

Further laboratory testing has been conducted with AN prills from 6 sources that are used in the N. America. In each case, dispersant surfactants were identified that would mitigate problems with the prill additives (particularly the organic coatings) in dissolving the AN prills into oxidizer solutions for use in making explosive emulsions.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A method of forming a nitrate solution with reduced additive agglomeration, the method comprising:

dissolving in water nitrate grills having an additive to form an aqueous nitrate solution including the additive, wherein the additive tends to agglomerate in aqueous solutions; and dispersing the additive by adding a surfactant to the aqueous nitrate solution; wherein the surfactant resists agglomeration of the additive, and dispersion of the additive reduces destabilization of emulsion explosives by the additive.

2. The method of claim 1, wherein the nitrate prill comprises a nitrate salt selected from the group consisting of: calcium nitrate, sodium nitrate, ammonium nitrate, and mixtures thereof.

3. The method of claim 1, wherein the nitrate prill comprises ammonium nitrate.

4. The method of claim 1, wherein the additive is selected from the group consisting of: mineral oil, waxes, anionic surfactant, cationic surfactant, nonionic surfactant, and mixtures thereof.

5. The method of claim 1, wherein the additive is present in an organic coating covering the surface of the nitrate prill.

6. The method of claim 1, wherein the additive is present throughout the nitrate prill.

7. The method of claim 1, wherein the surfactant is selected from the group consisting of: alkoxylated diamines, alkanolamides, alkyl esters, alkyl amines, alkyl amine ethoxylates, alkyl sulfonates, alkyl napthalene sulfonate, amine oxides, amine ethoxylates, amido amines, betaine amphoterics, carboxylated ether amines, ethoxylated alcohols, ethoxylated nonyl phenols, ethoxylated amines, ethoxylated triglycerides, ethoxylated amines, ethoxylated glycerol esters, ethoxylated alkyl phenols, ethoxylated polyglycerol esters, ethoxylated sorbitol esters, ethoxylated fatty acids, ethoxylated ether amines, ether amines, fatty acid alkanolamides, glycerol esters, glycol esters, imidazolines, imidazolinium amphoterics, monohydric alcohol esters, nonyl phenol ethoxylates, organo phosphates, organo phosphate ethoxylates, polyglycerol esters, polyhydric alcohol esters, quaternaries, silicone based surfactants, sorbitol fatty acid esters, sulfosuccinates, sultaines, and mixtures thereof.

8. The method of claim 1, wherein the surfactant is an alkyl amine ethoxylate, cocamidopropyl hydroxyl sultaine, or mixture thereof.

9. The method of claim 1, wherein the surfactant is added to the aqueous ammonium nitrate solution in an amount of about 0.0005 wt % to 1.0 wt %.

10. The method of claim 1, wherein the surfactant disperses the additive upon mixing of the surfactant with the aqueous ammonium nitrate solution.

11. The method of claim 1, wherein after adding of the surfactant, the aqueous ammonium nitrate solution maintains dispersion of the additives for up to 30 minutes.

12. A method of reducing contamination in a mixing tank for an aqueous nitrate salt solution, the method comprising:

dissolving in a mixing tank a nitrate prill having an additive in water to form an aqueous nitrate salt solution, wherein the additive tends to agglomerate in the mixing tank, dispersing the additive by adding a surfactant to the aqueous nitrate salt solution wherein the surfactant resists agglomeration of the additive.

13. A method of making an emulsion explosive, the method comprising:

dissolving in water a nitrate grill having an additive to form a nitrate solution including the additive, wherein the additive tends to destabilize emulsion explosives;

dispersing the additive by adding a surfactant to the nitrate solution that resists agglomeration of the additive; and emulsifying the nitrate solution in a continuous fuel phase to form an emulsion explosive with reduced destabilization by the additive.

14. The method of claim 13, wherein the nitrate prill comprises a nitrate salt selected from the group consisting of: calcium nitrate, sodium nitrate, ammonium nitrate, or mixtures thereof.

15. The method of claim 13, wherein the additive is selected from the group consisting of: mineral oil, waxes, anionic surfactant, cationic surfactant, nonionic surfactant, or mixtures thereof.

16. The method of claim 13, wherein the surfactant is selected from the group consisting of: hydrotropes, alkoxylated diamines, alkanolamides, alkyl esters, alkyl amines, alkyl amine ethoxylates, alkyl sulfonates, alkyl napthalene sulfonate, amine oxides, amine ethoxylates, amido amines, betaine amphoterics, block copolymer surfactants, carboxylated ether amines, ethoxylated alcohols, ethoxylated nonyl phenols, ethoxylated amines, ethoxylated triglycerides, ethoxylated amines, ethoxylated glycerol esters, ethoxylated alkyl phenols, ethoxylated polyglycerol esters, ethoxylated sorbitol esters, ethoxylated fatty acids, ethoxylated ether amines, ether amines, fatty acid alkanolamides, glycerol esters, glycol esters, imidazolines, imidazolinium amphoterics, monohydric alcohol esters, nonyl phenol ethoxylates, organo phosphates, organo phosphate ethoxylates, polyglycerol esters, polyhydric alcohol esters, quaternaries, silicone based surfactants, sorbitol fatty acid esters, sulfosuccinates, sultaines, and mixtures thereof.

17. The method of claim 13, wherein the surfactant is added to the nitrate solution in an amount of about 0.0005 wt % to 1.0 wt %.

18. The method of claim 13, wherein after adding of the surfactant, the nitrate solution maintains dispersion of the additives for up to 30 minutes.

19. The method of claim 12, wherein the additive is an anti-caking agent or agents covering the surface of the nitrate prill or present throughout the nitrate prill.

20. The method of claim 12, wherein the nitrate prill comprises ammonium nitrate.

21. The method of claim 12, wherein the surfactant is selected from the group consisting of: hydrotropes, alkoxylated diamines, alkanolamides, alkyl esters, alkyl amines, alkyl amine ethoxylates, alkyl sulfonates, alkyl napthalene sulfonate, amine oxides, amine ethoxylates, amidoamines, betaine amphoterics, block copolymer surfactants, carboxylated ether amines, ethoxylated alcohols, ethoxylated nonyl phenols, ethoxylated amines, ethoxylated triglycerides, ethoxylated amines, ethoxylated glycerol esters, ethoxylated alkyl phenols, ethoxylated polyglycerol esters, ethoxylated sorbitol esters, ethoxylated fatty acids, ethoxylated ether amines, ether amines, fatty acid alkanolamides, glycerol esters, glycol esters, imidazolines, imidazolinium amphoterics, monohydric alcohol esters, nonyl phenol ethoxylates, organo phosphates, organo phosphate ethoxylates, polyglycerol esters, polyhydric alcohol esters, quaternaries, silicone based surfactants, sorbitol fatty acid esters, sulfosuccinates, sultaines, and mixtures thereof.

22. The method of claim 12, wherein the surfactant disperses the additive upon mixing of the surfactant with the aqueous nitrate salt solution.

23. The method of claim 12, wherein after adding of the surfactant, the aqueous nitrate salt solution maintains dispersion of the additives for up to 30 minutes.

* * * * *